US010267585B2

(12) United States Patent
Foster

(10) Patent No.: US 10,267,585 B2
(45) Date of Patent: Apr. 23, 2019

(54) TRIGGER HAVING A MOVABLE SEAR AND FIREARMS INCORPORATING SAME

(71) Applicant: FOSTECH MFG LLC, Seymour, IN (US)

(72) Inventor: David Foster, Seymour, IN (US)

(73) Assignee: FOSTECH, INC., Seymour, IN (US)

( * ) Notice: Subject to any disclaimer, the term of this patent is extended or adjusted under 35 U.S.C. 154(b) by 0 days.

(21) Appl. No.: 15/466,023

(22) Filed: Mar. 22, 2017

(65) Prior Publication Data

US 2017/0276447 A1 Sep. 28, 2017

Related U.S. Application Data

(63) Continuation-in-part of application No. 15/419,460, filed on Jan. 30, 2017.

(60) Provisional application No. 62/311,807, filed on Mar. 22, 2016, provisional application No. 62/288,385, filed on Jan. 28, 2016.

(51) Int. Cl.

| | |
|---|---|
| ***F41A 9/01*** | (2006.01) |
| ***F41A 19/12*** | (2006.01) |
| ***F41A 19/10*** | (2006.01) |
| ***F41A 17/56*** | (2006.01) |

(52) U.S. Cl.

CPC ..... *F41A 19/12* (2013.01); *F41A 17/56* (2013.01); *F41A 19/10* (2013.01)

(58) Field of Classification Search

CPC ..... F41A 19/10; F41A 19/12

See application file for complete search history.

(56) References Cited

U.S. PATENT DOCUMENTS

| | | | | |
|---|---|---|---|---|
| 3,029,708 | A * | 4/1962 | Marchisio | F41A 19/03 42/69.03 |
| 3,167,877 | A * | 2/1965 | Jungeling | F41A 19/42 42/69.03 |
| 3,626,805 | A * | 12/1971 | Shiplee, III | F41A 17/42 89/128 |
| 5,913,261 | A * | 6/1999 | Guhring | F41A 3/64 42/69.03 |
| 6,125,735 | A * | 10/2000 | Guhring | F41A 19/02 42/69.03 |
| 6,640,479 | B2 * | 11/2003 | Guhring | F41A 19/16 42/69.03 |
| 7,398,723 | B1 * | 7/2008 | Blakley | F41A 19/12 42/69.01 |

(Continued)

FOREIGN PATENT DOCUMENTS

| | | | | |
|---|---|---|---|---|
| DE | 102006048436 | A1 * | 2/2008 | F41A 19/16 |

*Primary Examiner* — Gabriel J. Klein

(74) *Attorney, Agent, or Firm* — Roberts IP Law; John Roberts

(57) ABSTRACT

Provided in various example embodiments is a firing mechanism for firearms including a trigger with a movable sear attached to the trigger. When dimensional interference occurs within the trigger group, the movable sear is displaced from a seated position to an unseated position, instead of moving the trigger out of the non-firing position. This allows a firearm to be cocked when the trigger is locked in safe mode, and allows a firearm to be placed into safe mode at any time, regardless of the position of the hammer. This functionality improves the effectiveness of automatic trigger locking mechanisms discussed in related applications, and may be applied in various forms to firearms generally.

10 Claims, 6 Drawing Sheets

(56) References Cited

U.S. PATENT DOCUMENTS

| | | | |
|---|---|---|---|
| 8,667,881 | B1 | 3/2014 | Hawbaker |
| 8,820,211 | B1 | 9/2014 | Hawbaker |

* cited by examiner

TRIGGER HAVING A MOVABLE SEAR AND FIREARMS INCORPORATING SAME

CROSS-REFERENCE TO RELATED APPLICATIONS

This application claims priority to, incorporates herein by reference, and is a non-provisional of U.S. provisional patent application No. 62/311,807 to David Foster, filed Mar. 22, 2016 and entitled Trigger Having a Moveable Sear and Firearms Incorporating Same (herein "the '807 Application"). This application also claims priority to and incorporates herein by reference U.S. patent application Ser. No. 15/419,460 to David Foster, filed Jan. 30, 2017 and entitled Trigger-Locking Apparatus, System, and Method for Semiautomatic Firearms (herein "the '460 Application"). This application further claims priority to, incorporates herein by refernce, and is a nonprovisional of U.S. provisional patent application No. 62/288,385 to David Foster, filed Jan. 28, 2016 and entitled Timing Apparatus, System, and Method for Dual Mode Trigger for Semiautomatic Firearms (herein "the '385 Application").

FEDERALLY SPONSORED RESEARCH OR DEVELOPMENT

None.

TECHNICAL FIELD

The present invention relates generally to firearms, and more particularly to improvements to trigger systems for firearms.

BACKGROUND

Selectable dual mode triggers for semiautomatic firearms are known, which include triggers capable of actuating and firing rounds on both pull and release of the trigger. Examples of such systems are disclosed in U.S. Pat. No. 8,667,881 B1 to Hawbaker, granted 2014 Mar. 11 (herein "the '881 Patent"), and U.S. Pat. No. 8,820,211 B1 to Hawbaker, granted 2014 Sep. 2 (herein "the '211 Patent") (collectively "the Hawbaker patents"), both of which are incorporated herein by reference. The characteristics of selecting modes of actuation in which only one round is discharged with one function of the trigger was approved by the ATF and granted the patents mentioned above and incorporated herein.

The introduction of a trigger that actuates on both pull and release presents several challenges. During the testing of this new trigger, misfires were sometimes experienced due to light primer strikes, unexpected trigger states during actuation, and magazine changes. It quickly became apparent that improvements were needed to address these and related issues.

For example, it became apparent that there needed to be a mechanism added to the trigger that would ensure that the carrier is seated before the trigger is actuated, so that the anti-hammer-follow-disconnect does not engage out of sequence and so that the firearm could be placed in safe mode (safety on) at any time. The mechanism would need to ensure activities occur in the proper sequence and that the trigger and firearm are ready for the next desired function to occur. The addition of a special automatic trigger lock (sometimes referred to as a "timing lever" in the '807 Application) as described in the '460 Application ensured that the sequence of events is maintained in the proper relationship, eliminating misfires, jams and out-of-battery discharge. While that trigger lock was intended to control the sequence of activities, it became apparent during subsequent testing that intermittent failures were still occurring. In working to solve these problems, innovations were discovered that have applicability to not only pull-and-release triggers, but also to firearms generally.

SUMMARY

It was discovered that intermittent failures were still occurring because the automatic trigger lock of the '460 Application could not engage and lock the trigger into the non-firing position when the trigger was momentarily being held out of the non-firing position by dimensional interference from the hammer as the hammer cycled, for instance as depicted in FIG. 2. After further analysis, the present inventor discovered that changes in the geometry and/or functionality of the interface between the hammer and the trigger could allow the trigger lock of the '460 Application to function as intended, and would also enable putting a firearm into safe mode at any time. Specifically, modifications were made to the geometry of the hammer and the trigger was divided into two parts: the trigger and a movable sear. The trigger and movable sear may be pinned together, for example, and the movable sear may be biased into a seated position, for instance with a spring. The movable sear shifts from the seated position to an unseated position when interference occurs between the hammer and the trigger. This displacement of the sear allows the hammer to rotate past the sear to the hammer's cocked position while the trigger is locked in the non-firing position, for instance by a selector switch placed in safe mode or by the trigger lock of the '460 Application. This discovery has applicability to and benefits for firearms generally.

This application discusses in detail an example embodiment employing a movable sear that is biased to allow the hammer and trigger sear surfaces to perform their standard function in a firearm fire control group with the additional functionality of eliminating the inherent interference that occurs in high fire-rate triggers today and in the automatic trigger lock of the '460 Application. Provided herein is one means of improving the performance of such high fire-rate triggers, which in various example embodiments allows for a firearm to be cocked when the trigger is locked in safe mode, and allows a firearm to be placed into safe mode at any time, regardless of the charge state of the firearm.

Accordingly, provided in various example embodiments is a firing mechanism for a firearm, comprising: a trigger movable between at least firing and non-firing positions and spring-biased toward the non-firing position; a sear mounted to the trigger and movable relative to the trigger between at least seated and unseated positions and spring-biased toward the seated position; a hammer movable between at least cocked and fire positions and spring-biased toward the fire position; the sear configured and positioned to engage the hammer and prevent the hammer from moving to the fire position when the hammer is in the cocked position and the trigger is in the non-firing position; the sear configured and positioned to disengage the hammer and allow the hammer to move from the cocked position to the fire position when the trigger is moved from the non-firing position to the firing position; where the hammer is configured and positioned to move the sear from the seated position toward the unseated position, and then to allow the sear to return to the seated position, as the hammer moves from the fire position to the cocked position while the trigger is in the non-firing position.

In various example embodiments the firing mechanism may further comprise a safety selector switch mechanism movable between at least a safety position and one or more fire positions, the safety selector switch mechanism configured and positioned to selectably lock the trigger in the non-firing position by preventing the trigger from moving from the non-firing position to the firing position when the safety selector switch mechanism is in the safety position, and by allowing the trigger to move between the non-firing and firing positions when the safety selector switch mechanism is not in the safety position.

In various example embodiments the firing mechanism may further comprise a trigger lock mechanism movable between at least a locked position and an unlocked positions, the trigger lock mechanism configured and positioned to lock the trigger in the non-firing position by preventing the trigger from moving from the non-firing position to the firing position when the trigger lock mechanism is in the locked position, and by allowing the trigger to move between the non-firing and firing positions when the trigger lock mechanism is not in the unlocked position. In various example embodiments the firearm is a semi-automatic firearm comprising an action configured to cycle when the firearm is fired, and the trigger lock mechanism is configured to automatically move to the locked position when the action is cycling, and to automatically move to the unlocked position when the action is in-battery ready to fire a cartridge. In various example embodiments the trigger is movable between at least the firing and non-firing positions by pivoting about a first axis. In various example embodiments the sear is pivotably mounted to the trigger about a second axis.

Also provided in various example embodiments is a firearm with a hammer and a trigger that can be placed in a non-firing position regardless of the hammer's position, the firearm capable of being cocked while the trigger is in a non-firing position, wherein the firearm comprises a firing mechanism as described herein.

Further provided in various example embodiments is a method of operating a firearm, comprising the steps of providing a firearm comprising a firing mechanism as described herein; and locking the trigger in the non-firing position by moving the safety selector switch mechanism to the safety position. In various example embodiments the step of locking the trigger in the non-firing position by moving the safety selector switch mechanism to the safety position may be performed while the hammer is not in the cocked position, such as when the hammer is in the fire position. In various example embodiments the method may further comprise the steps of cocking the firearm while the trigger is locked in the non-firing position. In various example embodiments the method may further comprise the steps of unlocking the trigger from the non-firing position, while the firearm is cocked, by moving the safety selector switch mechanism from the safety position to the one or more fire positions. In various example embodiments the method may further comprise the steps of firing the firearm by moving the trigger from the non-firing position to the firing position.

The foregoing summary is illustrative only and is not meant to be exhaustive or limiting. Other aspects, objects, and advantages of various example embodiments will be apparent to those of skill in the art upon reviewing the accompanying drawings, disclosure, and appended claims. These together with other objects of the invention, along with various features of novelty, which characterize the invention, are pointed out with particularity in the claims annexed hereto and forming a part of this disclosure. For a better understanding of the invention, its operating advantages and the specific objects attained by its uses, reference should be had to the accompanying and incorporated drawings, claims and descriptive matter in which there is illustrated a preferred embodiment of the invention.

DETAILED DESCRIPTION OF EXAMPLE EMBODIMENTS

Figure 1:
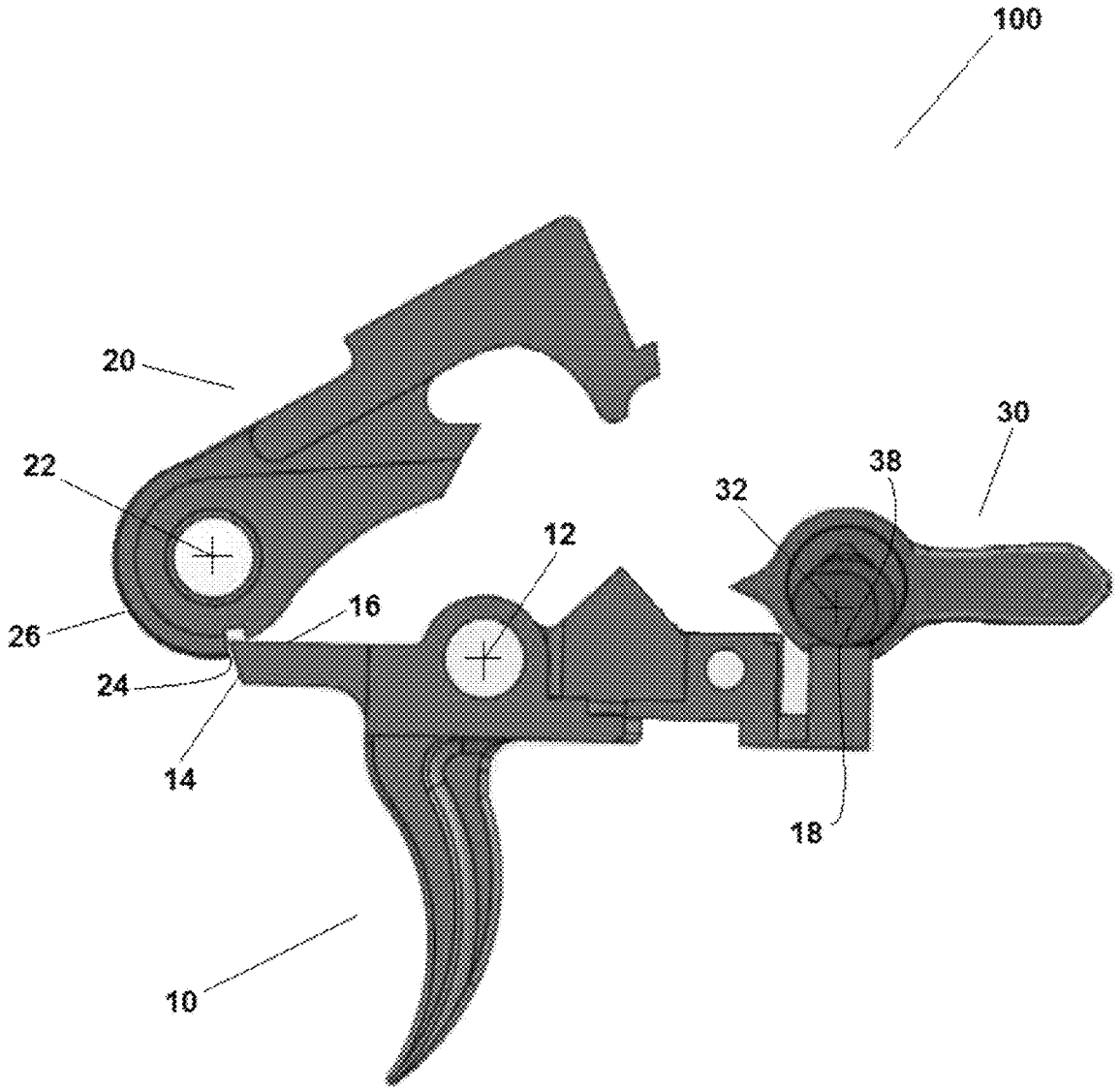
FIG. 1 (Prior Art)
FIG. 1 is a side elevation view of an example firing mechanism for a firearm according to the prior art, with the hammer in the cocked position and the selector switch positioned in safe mode, locking the trigger in the non-firing position.

Reference will now be made in detail to some specific example embodiments, including any best mode contemplated by the inventor. Examples of these specific embodiments are illustrated in the accompanying drawings. While the invention is described in conjunction with these specific embodiments, it will be understood that it is not intended to limit the invention to the described or illustrated embodiments. On the contrary, it is intended to cover alternatives, modifications, and equivalents as may be included within the spirit and scope of the invention as defined by the appended claims.

In the following description, numerous specific details are set forth in order to provide a thorough understanding of the present invention. Particular example embodiments may be implemented without some or all of these features or specific details. In other instances, components and procedures well known to persons of skill in the art have not been described in detail in order not to obscure inventive aspects.

Various techniques and mechanisms will sometimes be described in singular form for clarity. However, it should be noted that some embodiments may include multiple iterations of a technique or multiple components, mechanisms, and the like, unless noted otherwise. Similarly, various steps of the methods shown and described herein are not necessarily performed in the order indicated, or performed at all in certain embodiments. Accordingly, some implementations of the methods discussed herein may include more or fewer steps than those shown or described.

Further, the example techniques and mechanisms described herein will sometimes describe a connection, relationship or communication between two or more items or entities. It should be noted that a connection or relationship between entities does not necessarily mean a direct, unimpeded connection, as a variety of other entities or processes may reside or occur between any two entities. Consequently, an indicated connection does not necessarily mean a direct, unimpeded connection unless otherwise noted.

To ensure clarity, an explanation of the term "in-battery" will now be provided. "In-battery" refers to the status of a firearm once the action has returned to the normal firing position. Out-of-battery refers to the status of a firearm before the action has returned to the normal firing position. According to the website Wikipedia, the term originates from artillery, referring to a gun that fires before it has been pulled back. In artillery guns, "out of battery" usually refers to a situation where the recoiling mass (breech and barrel) has not returned to its proper position after firing because of a failure in the recoil mechanism. Gun carriages should normally be designed to prevent this in typical circumstances. But if a gun is fired out of battery, then damage to the carriage can occur, as the effectiveness of the recoil mechanism will have been compromised. In firearms and artillery where there is an automatic loading mechanism, a condition can occur in which a live round is at least partially in the firing chamber and capable of being fired, but is not properly secured by the usual mechanism of that particular weapon (and thus is not "in battery"). The gas pressure produced at the moment of firing can rupture the not-fully-supported cartridge case and can result in flame and high-pressure gas being vented at the breech of the weapon, potentially creating flying shrapnel and possibly injuring the operator. Depending on the design, it is also possible for a semi-automatic firearm to simply not fire upon pulling the trigger when in an out-of-battery state.

Figure 2:
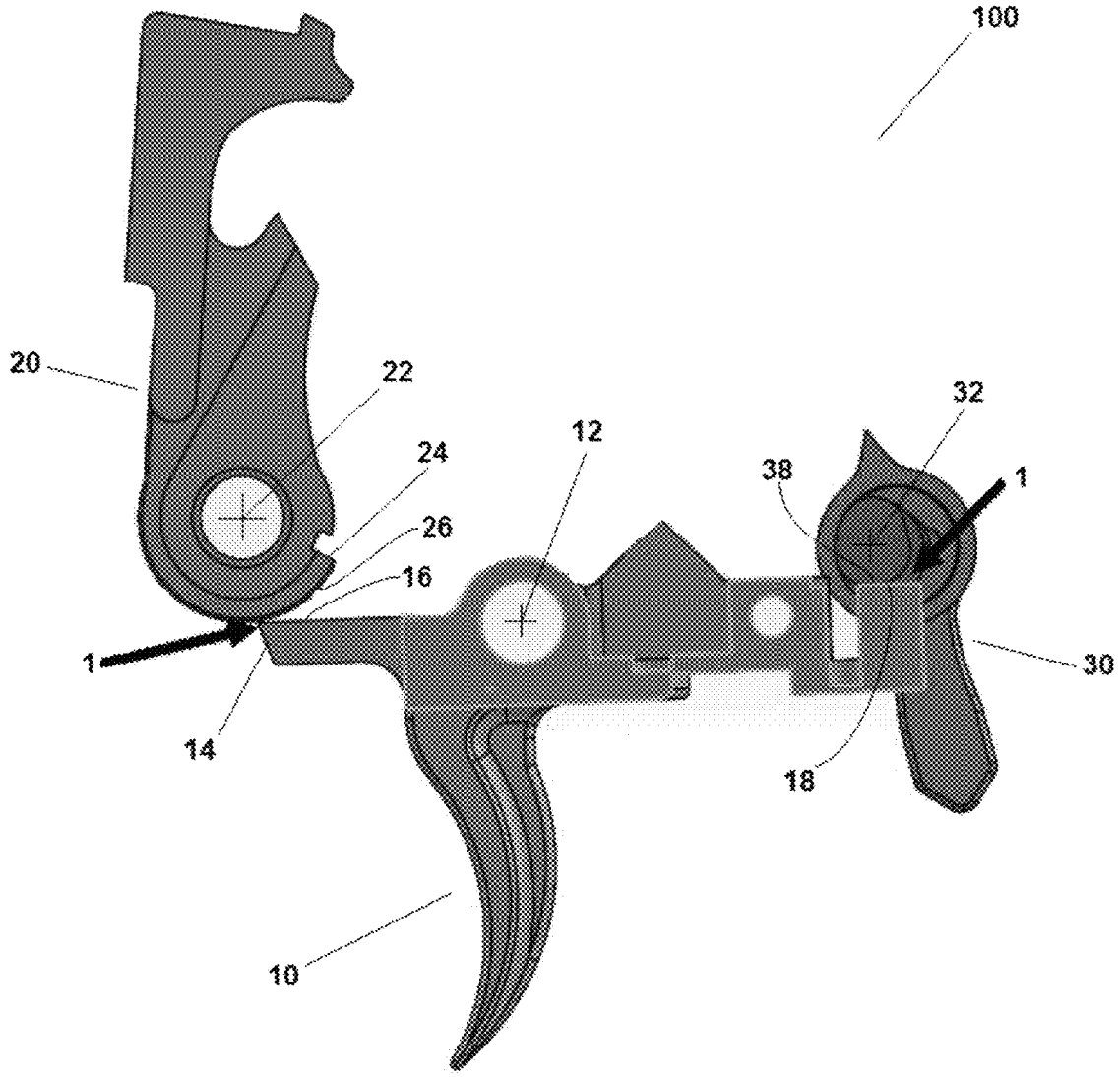
FIG. 2 (Prior Art)
FIG. 2 is a side elevation view of the example prior art firing mechanism of FIG. 1, with the hammer in the fire position, illustrating that the selector switch cannot then be moved from fire mode to safe mode due to interference between the hammer and the trigger.

Referring now to the drawings in detail wherein like elements are indicated by like numerals, an example of a prior art firing mechanism 100 for a firearm (not shown) is illustrated in FIGS. 1 and 2. A typical prior art firing mechanism 100 may include a trigger 10 movable between at least firing and non-firing positions, for instance by pivoting about an axis 12. Alternatively, the trigger 10 may translate longitudinally (not shown) instead of or in addition to pivoting. The trigger 10 is typically spring-biased toward the non-firing or forward position shown in FIG. 1 (i.e., rotated clockwise about axis 12 as shown in FIG. 1). Prior art firing mechanisms 100 may also include a hammer 20 movable between at least a cocked position (shown in FIG. 1), and a fire position (shown in FIG. 2), for instance by rotating about an axis 22. The hammer 20 is typically spring-biased toward the fire position shown in FIG. 2. A portion of the trigger 10 engages the hammer 20 in the cocked position until the trigger 10 is pulled; that portion of the trigger 10 is typically called a sear 16, which includes a sear surface 14 that slidably engages a corresponding surface 24 on the hammer 20 when the hammer 20 is cocked and the trigger 10 is in the non-firing position (FIG. 1).

To prevent the trigger 10 in FIG. 1 from being pulled and releasing the hammer 20 and thus firing the firearm, a firing mechanism 100 may also include a safety mechanism, such as a selector switch mechanism 30 movable between at least a safety position (shown in FIG. 1) and one or more fire positions (e.g., FIG. 2). A safety selector switch mechanism 30 may be configured and positioned as shown to selectably lock the trigger 10 in the non-firing position (shown in FIG. 1) by causing a surface 38 of the safety selector switch mechanism 30 to abut and block proximal movement of an adjacent surface 18 of the trigger 10, thereby preventing the trigger 10 from pivoting counter-clockwise about axis 12 from the non-firing position (as shown in FIG. 1) to the firing position (shown in FIG. 2) when the safety selector switch mechanism 30 is rotated about its axis 32 to the safety position shown in FIG. 1.

Rotating the safety selector switch mechanism 30 about its axis 32 to the fire position shown approximately in FIG. 2 (the fire position would be with mechanism 30 pointed vertically down) creates a clearance between surface 38 of the safety selector switch mechanism 30 and adjacent surface 18 of the trigger 10, thereby allowing the trigger 10 to pivot counter-clockwise about axis 12 from the non-firing position (as shown in FIG. 1) to the firing position (shown in FIG. 2), thereby causing the sear surface 14 of the trigger 10 to slide past and release the corresponding surface 24 on the hammer 20, allowing the hammer 20 to rotate counter-clockwise about its axis 22 and fire the firearm.

FIG. 2 depicts a problem that can arise with safety mechanisms 30 that function by moving the trigger 10 to the non-fire position and/or locking the trigger 10 in the non-fire position. Specifically, if the hammer 20 is in the fire position shown in FIG. 2 or other positions where a surface 26 of the hammer 20 dimensionally interferes with proximal movement of the sear 16 portion of the trigger 10, then attempting to move the selector switch mechanism 30 from the fire positions (e.g., FIG. 2) to the safety position (shown in FIG. 1) can cause simultaneous interference 1 between, on one hand, surface 38 of the selector switch mechanism 30 and adjacent surface 18 of the trigger 10, and on the other hand, surface 26 of the hammer and the sear 16 portion of the trigger 10. Due to this interference 1, such prior art firing mechanisms 100 can only be placed in a non-firing position (FIG. 1) if the hammer 20 is in a position where a surface 26 of the hammer 20 does not dimensionally interfere with proximal movement of the sear 16 portion of the trigger 10. In other words, such systems 100 cannot be placed in safe mode (FIG. 1) unless the hammer 20 happens to be in the right (non-interfering) position. For the same reason, an automatic trigger lock of the type described in the '460 Application, which intermittently locks the trigger 10 in a non-firing position (FIG. 1), cannot engage the trigger 10 of such a system 100 unless the hammer 20 happens to be in the right (non-interfering) position.

Additionally, such prior art firing mechanisms 100 cannot be cocked while the trigger 10 is locked in a non-firing position (e.g., when in safe mode as shown in FIG. 1), because dimensional interference 1 will occur as described above and shown in FIG. 2. By "cocked" it is meant that the hammer 20 is moved from a non-cocked position (e.g., FIG. 2) to the cocked and ready-to-fire position shown in FIG. 1, for instance by cycling of the action of the firearm (not shown). While not reproduced in the present figures for the sake of visual clarity, it is well known that semiautomatic firearms typically have a mechanism commonly known as an action that cycles by loading, firing, and extracting cartridges when the firearm is repeatedly fired by movements of the trigger.

Figure 3:
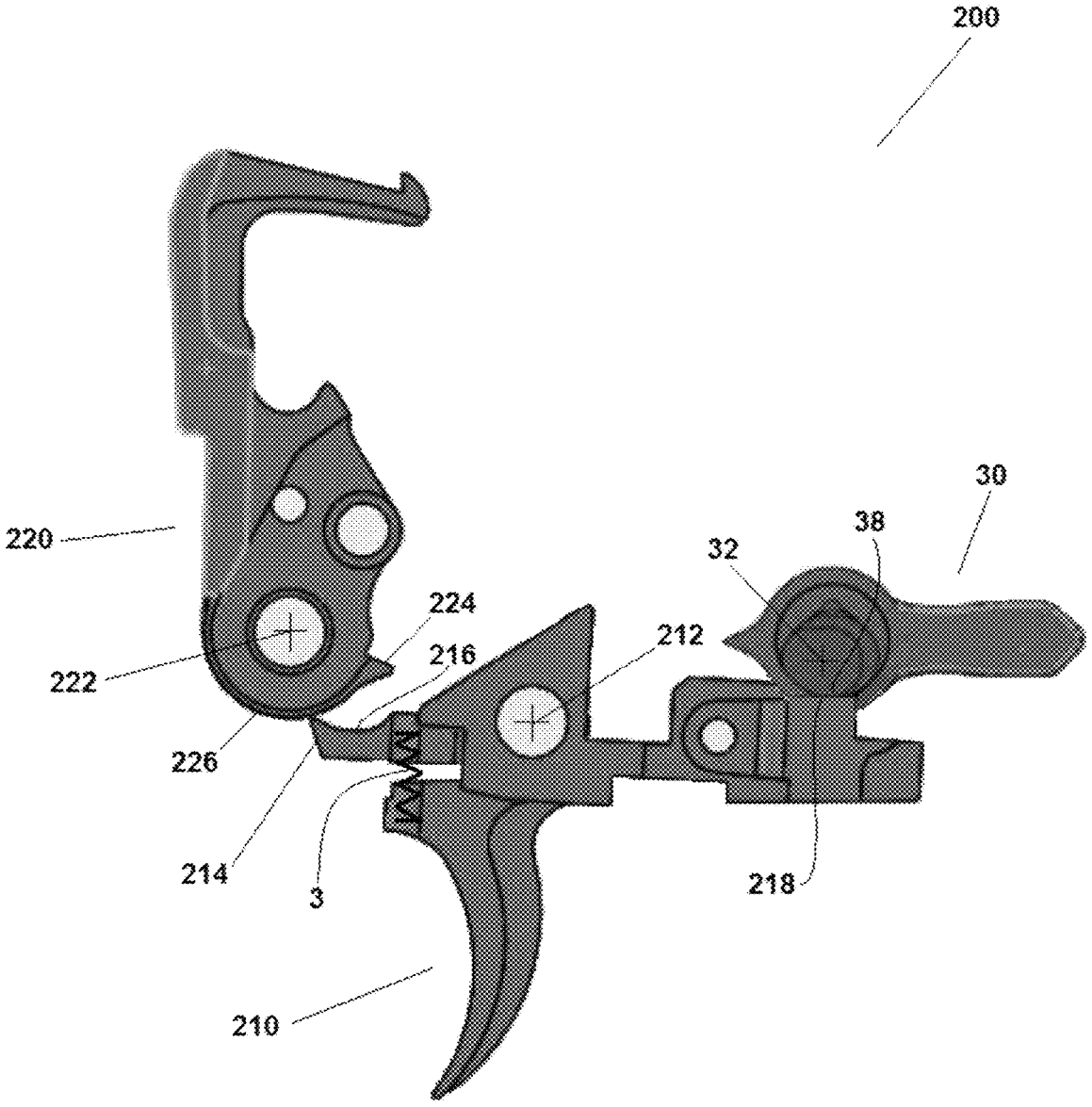
FIG. 3 is a side elevation view of an example firing mechanism for a firearm according to various example embodiments, with the hammer in the fire position and the movable sear seated, while the selector switch is in safe mode, locking the trigger in the non-firing position.
Figure 4:
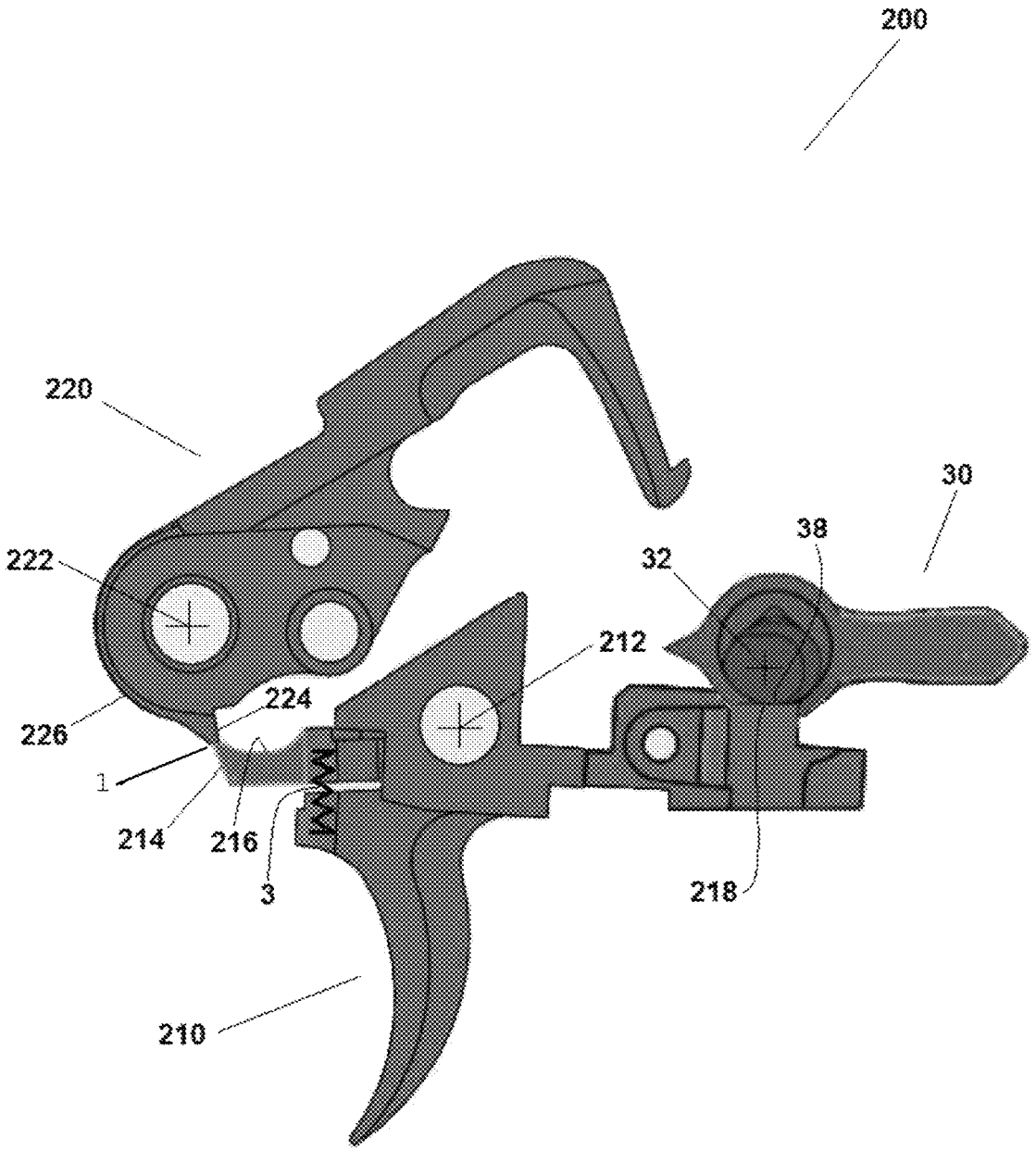
FIG. 4 is a side elevation view of the example firing mechanism of FIG. 3, with the hammer located between the fire and cocked positions and displacing the movable sear away from the seated position, while the selector switch is in safe mode, locking the trigger in the non-firing position.
Figure 5:
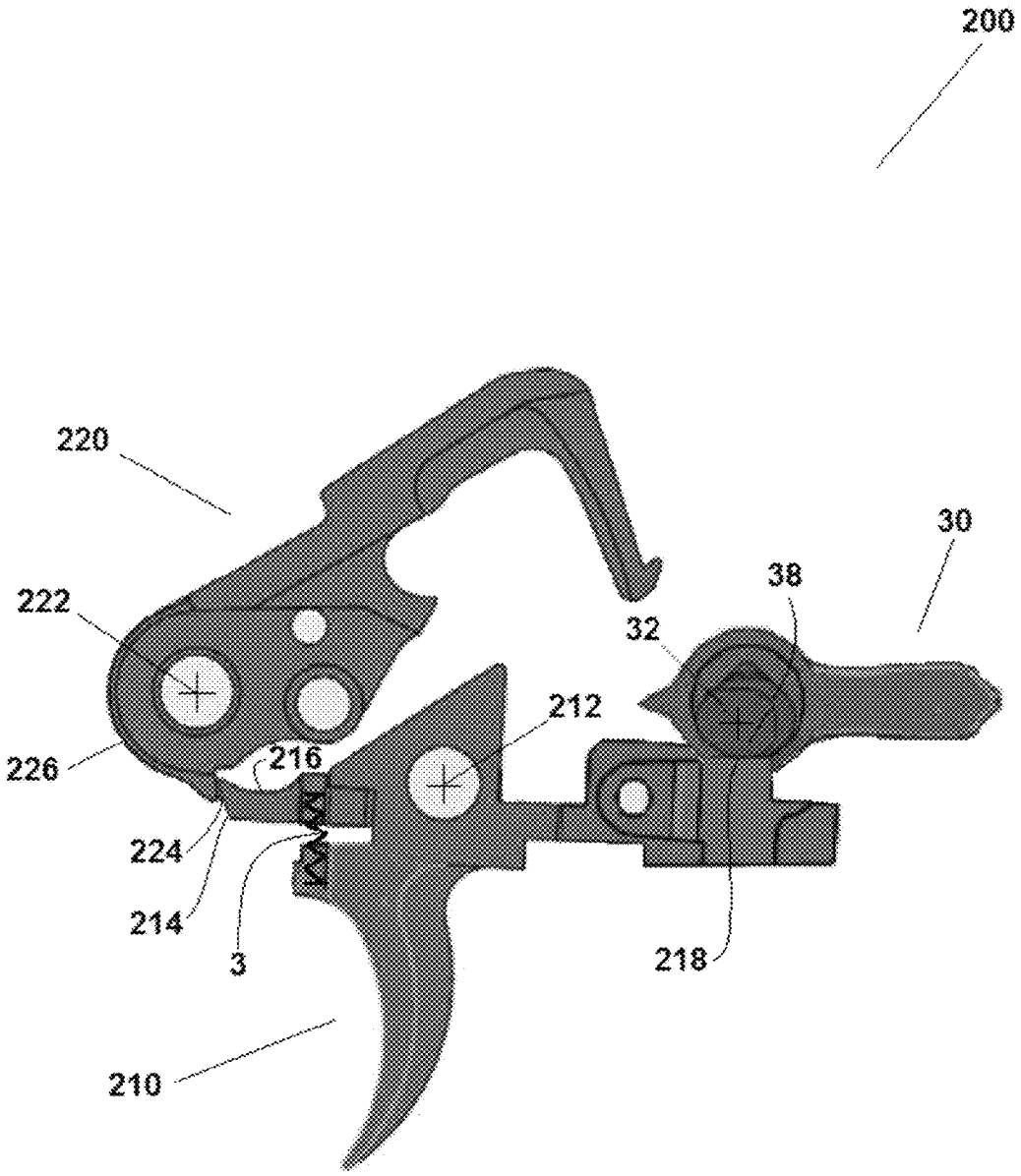
FIG. 5 is a side elevation view of the example firing mechanism of FIG. 3, with the hammer located in the cocked position and the movable sear seated, while the selector switch is in safe mode, locking the trigger in the non-firing position.

An example of a firing mechanism 200 that overcomes the drawbacks of prior art mechanisms 100 is illustrated in FIGS. 3 through 6. Provided in various example embodiments is a firing mechanism 200 for a firearm (not shown), which may include a trigger 210 movable between at least firing and non-firing positions, for instance by pivoting about an axis 212. Alternatively, the trigger 210 may translate longitudinally (not shown) instead of or in addition to pivoting. The trigger 210 is typically spring-biased toward the non-firing or forward position shown in FIGS. 3-5 (i.e., rotated clockwise about axis 212 as shown in FIGS. 3-5). Firing mechanisms 200 may also include a hammer 220 movable between at least a cocked position (shown in FIG. 5), and a fire position (shown in FIG. 3), for instance by rotating about an axis 222. The hammer 220 is typically spring-biased toward the fire position shown in FIG. 3.

Figure 6:
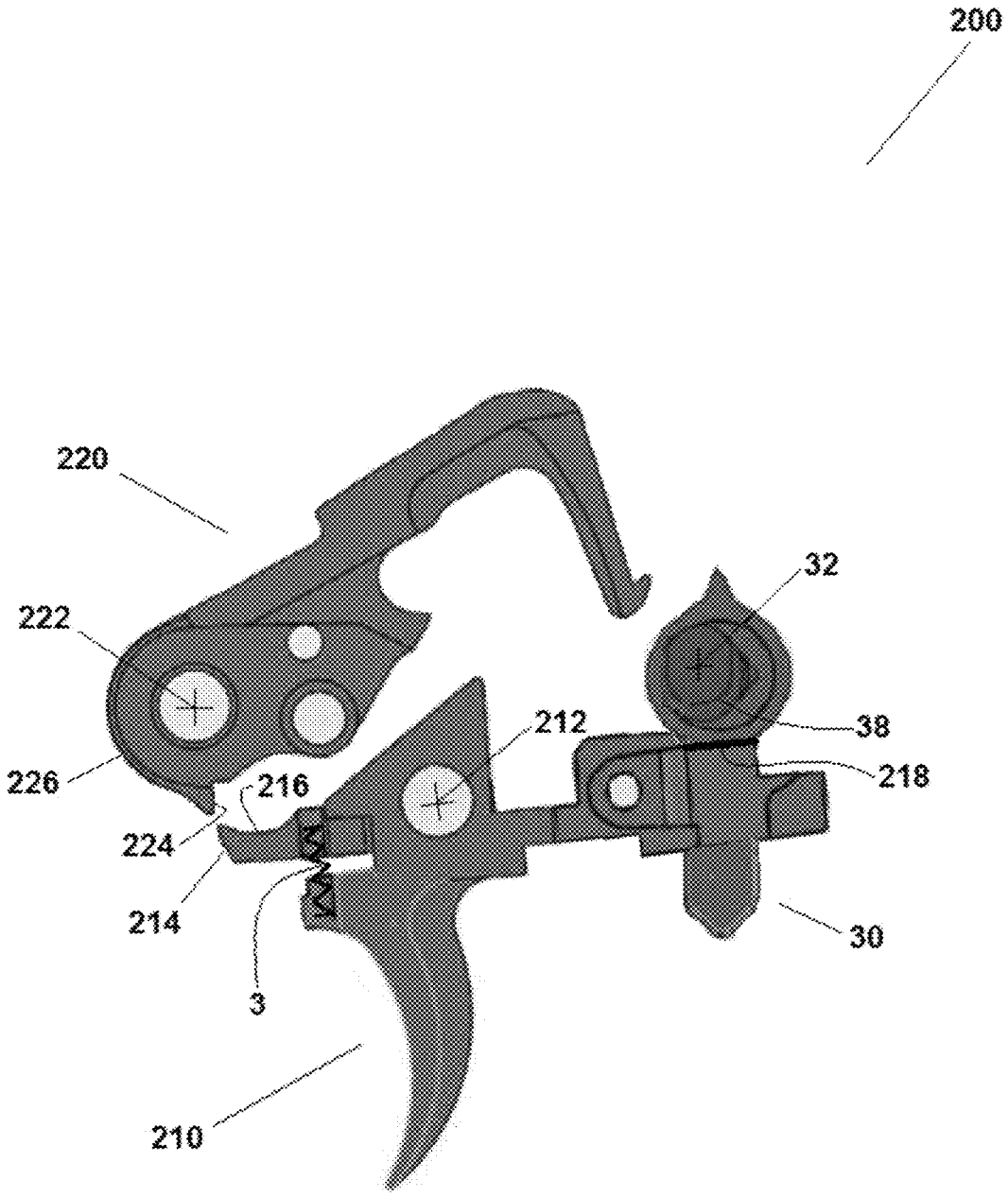
FIG. 6 is a side elevation view of the example firing mechanism of FIG. 3, with the selector switch moved to a fire mode, and the trigger moved from the non-firing position to the firing position, disengaging the movable sear from the hammer so that the hammer is free to rotate from the cocked position to the fire position to fire the firearm.

With reference to FIGS. 3-6, the trigger is divided into at least two adjoined parts: the trigger 210 and a movable sear 216. The trigger 210 and movable sear 216 may be pivotably joined together about an axis, for instance with a pin (shown in the '807 Application), or may be slidably joined together, for instance with a protrusion riding in a slot (not shown). The movable sear 216 is attached to and moves with the trigger 210, but also is capable of moving independently of the trigger 210. The movable sear 216 may be biased into a seated position (shown in FIGS. 3, 5, 6), for instance with a spring 3. The movable sear 216 shifts from the seated position (shown in FIGS. 3, 5, 6) to an unseated position (shown in FIG. 4) when interference 1 occurs between the hammer 220 and the sear 216. As demonstrated by the sequence shown in FIGS. 3-5, this displacement of the sear 216 due to interference 1 allows the hammer 220 (including surface 226 and protrusion 224) to rotate about axis 222 from the fire position (FIG. 3) past the sear 216 (FIG. 4) to the hammer's cocked position (FIG. 5) while the trigger 210 is locked in the non-firing position (FIGS. 3-5), for instance by a selector switch 30 placed in safe mode (FIGS. 3-5) or by the trigger lock of the '460 Application. When in the cocked position (FIG. 5), the sear surface 214 on the movable sear 216 engages the corresponding surface/abutment 224 on the hammer 220, thereby holding the hammer 220 in place until the trigger 210 is pulled and moved from the non-firing position (FIGS. 3-5) to the firing position (FIG. 6). In various example embodiments firing mechanism 200 may include a hammer 220 with material removed from the interference surface 226 (compare surface 26 in FIG. 2), and surface 226 may include a concave profile as it transitions to engagement surface/abutment 224. In various example embodiments the movable sear 216 may comprise a concave upper surface and an angled engagement surface 214 to slidably engage a correspondingly angled engagement surface on the abutment 224 of the hammer 220, as shown in FIGS. 3-6. Said angled surfaces 214, 224, when used, tend to form a positive engagement by being somewhat wedged together by the spring force urging the hammer 220 to rotate in the counter-clockwise direction (as shown in the Figures).

To prevent the trigger 210 from being pulled and releasing the hammer 220 and thus firing the firearm, a firing mechanism 200 may include a safety mechanism, such as a selector switch mechanism 30 movable between at least a safety position (shown in FIGS. 3-5) and one or more fire positions (e.g., FIG. 6). A safety selector switch mechanism 30 may be configured and positioned as shown to selectably lock the trigger 10 in the non-firing position or "safe mode" (shown in FIGS. 3-5) by causing a surface 38 of the safety selector switch mechanism 30 to abut and block proximal movement of an adjacent surface 218 of the trigger 210, thereby preventing the trigger 210 from pivoting about axis 212 from the non-firing position (shown in FIGS. 3-5) to the firing position (shown in FIG. 6) when the safety selector switch mechanism 30 is rotated about its axis 32 to the safety position shown in FIGS. 3-5. Rotating the safety selector switch mechanism 30 about its axis 32 to the fire position shown in FIG. 6 creates a clearance between surface 38 of the safety selector switch mechanism 30 and adjacent surface 218 of the trigger 210, thereby allowing the trigger 210 to pivot counter-clockwise about axis 212 from the non-firing position (as shown in FIGS. 3-5) to the firing position (shown in FIG. 6), thereby causing the sear surface 214 of the movable sear 216 to slide past and release the corresponding surface 224 on the hammer 220, allowing the hammer 220 to rotate counterclockwise about its axis 222 (e.g., as shown in FIG. 3) and fire the firearm.

To prevent the trigger 210 from being moved from the non-firing position (FIGS. 3-5) to the firing position (FIG. 6) during cycling of the action of the firearm (not shown), an automatic intermittent trigger lock mechanism like that disclosed and claimed in the '460 Application may be employed with the present firing mechanism 200. For example, the trigger lock of the '460 Application may be provided in a semi-automatic firearm comprising an action configured to cycle when the firearm is fired, and the trigger lock mechanism may be configured to automatically move to the locked position when the action is cycling, and to automatically move to the unlocked position when the action is in-battery ready to fire a cartridge, as described in the '460 Application. In those embodiments, whenever the trigger lock of the '460 Application locks the trigger 210 in the non-firing position, the hammer 220 can still cycle from the fire position to the cocked position as depicted in FIGS. 3-5 by unseating and momentarily displacing the movable sear 216 as described above with respect to FIGS. 3-5.

Similarly, whenever the trigger is locked in the non-firing position, whether by a safety selector 30 in safe mode or by a trigger lock of the '460 Application or for any other reason, the present firing mechanism 200 can still be cocked, for instance by manually sliding the action of the firearm (not shown) and thereby moving the hammer 220 from the fire position to the cocked position as depicted in FIGS. 3-5 by unseating and momentarily displacing the movable sear 216 as described above with respect to FIGS. 3-5.

The invention is not limited to just firing mechanisms incorporating ideas suggested herein, but also includes firearms incorporating such firing mechanisms, and methods of making and using same. For example and not by way of limitation, in various example embodiments a method of operating a firearm is provided, comprising the steps of providing a firearm incorporating a firing mechanism 200 with a movable sear 216 attached to a trigger 210 as described herein, and locking the trigger 210 in the non-firing position (FIGS. 3-5) by moving the safety selector switch mechanism 30 to the safety position (FIGS. 3-5). The step of moving the safety selector switch mechanism 30 to the safety position (FIGS. 3-5) may be performed while the hammer 220 is not in the cocked position (e.g., it could be performed when the hammer 220 is in the position shown in FIG. 4), because the resulting interference 1 will simply cause the movable sear 216 to move from the seated position (FIGS. 3, 5, 6) to the unseated position shown in FIG. 4. For the same reason, the step of moving the safety selector switch mechanism 30 to the safety position (FIGS. 3-5) may be performed while the hammer 220 is in any other position, such as the fire position (FIG. 3). Also, a firearm incorporating a firing mechanism 200 with a movable sear 216 attached to a trigger 210 as described herein can be cocked while the trigger 220 is locked in the non-firing position (FIGS. 3-5), because the resulting interference 1 will simply cause the movable sear 216 to move from the seated position (FIGS. 3, 5, 6) to the unseated position shown in FIG. 4. Once cocked, for instance as shown in FIG. 5, the trigger 210 can be unlocked, if applicable, from the non-firing position by moving the safety selector switch mechanism 30 from the safety position (FIG. 5) to the one or more fire positions (e.g., FIG. 6), and the firearm can then be fired by moving the trigger 210 from the non-firing position (FIG. 5) to the firing position (FIG. 6), which allows the hammer 220 to rotate counterclockwise (as shown in the Figures) about its axis 222 to the fire position (FIG. 3), thereby firing the firearm and causing the action of the firearm to cycle, including cycling a trigger lock mechanism according to the '460 Application, if provided.

It is understood that the above-described embodiments are merely illustrative of the application. Other embodiments may be readily devised by those skilled in the art, which may embody one or more aspects or principles of the invention and fall within the scope of the claims. For example, it is contemplated that the present principles could be employed with many other locking mechanisms other than those disclosed as locking structures 120, 220, 320, such as plunger designs, rotating cams, gears, or ratchets, or any other suitable structure that achieves the present purposes. Any suitable materials and manufacturing methods may be used as would be apparent to persons of skill in the art.

What is claimed is:

1. A firing mechanism for a firearm, comprising:

a trigger movable between at least firing and non-firing positions and spring-biased toward the non-firing position;

a sear mounted to the trigger and movable relative to the trigger between at least seated and unseated positions and spring-biased toward the seated position;

a hammer movable between at least cocked and fire positions and spring-biased toward the fire position;

the sear configured and positioned to engage the hammer and prevent the hammer from moving to the fire position when the hammer is in the cocked position and the trigger is in the non-firing position;

the sear configured and positioned to disengage the hammer and allow the hammer to move from the cocked position to the fire position when the trigger is moved from the non-firing position to the firing position;

the hammer configured and positioned to move the sear from the seated position toward the unseated position, and then to allow the sear to return to the seated position, as the hammer moves from the fire position to the cocked position while the trigger is in the non-firing position;

a trigger lock mechanism movable between at least a locked position and an unlocked position, the trigger lock mechanism configured and positioned to lock the trigger in the non-firing position by preventing the trigger from moving from the non-firing position to the firing position when the trigger lock mechanism is in the locked position, and by allowing the trigger to move between the non-firing and firing positions when the trigger lock mechanism is in the unlocked position;

wherein the firearm is a semi-automatic firearm comprising an action configured to cycle when the firearm is fired, and the trigger lock mechanism is configured to automatically move to the locked position when the action is cycling, and to automatically move to the unlocked position when the action is in-battery ready to fire a cartridge.

2. The firing mechanism of claim 1, further comprising a safety selector switch mechanism movable between at least a safety position and one or more fire positions, the safety selector switch mechanism configured and positioned to selectably lock the trigger in the non-firing position by preventing the trigger from moving from the non-firing position to the firing position when the safety selector switch mechanism is in the safety position, and by allowing the trigger to move between the non-firing and firing positions when the safety selector switch mechanism is not in the safety position.

3. A firearm with a hammer and a trigger that can be placed in a non-firing position regardless of the hammer's position, the firearm capable of being cocked while the trigger is in a non-firing position, the firearm comprising:

the trigger movable between at least firing and non-firing positions and spring-biased toward the non-firing position;

a sear mounted to the trigger and movable relative to the trigger between at least seated and unseated positions and spring-biased toward the seated position;

the hammer movable between at least cocked and fire positions and spring-biased toward the fire position;

the sear configured and positioned to engage the hammer and prevent the hammer from moving to the fire position when the hammer is in the cocked position and the trigger is in the non-firing position;

the sear configured and positioned to disengage the hammer and allow the hammer to move from the cocked position to the fire position when the trigger is moved from the non-firing position to the firing position;

the hammer configured and positioned to move the sear from the seated position toward the unseated position, and then to allow the sear to return to the seated position, as the hammer moves from the fire position to the cocked position while the trigger is in the non-firing position;

a trigger lock mechanism movable between at least locked and unlocked positions, the trigger lock mechanism configured and positioned to lock the trigger in the non-firing position by preventing the trigger from moving from the non-firing position to the firing position when the trigger lock mechanism is in the locked position, and by allowing the trigger to move between the non-firing and firing positions when the trigger lock mechanism is in the unlocked position;

wherein the firearm is a semi-automatic firearm comprising an action configured to cycle when the firearm is fired, and the trigger lock mechanism is configured to automatically move to the locked position when the action is cycling, and to automatically move to the unlocked position when the action is in-battery ready to fire a cartridge.

4. The firearm of claim 3, further comprising a safety selector switch mechanism movable between at least a safety position and one or more fire positions, the safety selector switch mechanism configured and positioned to move the trigger to the non-firing position if the trigger is not already in the non-firing position, and to lock the trigger in the non-firing position, when the safety selector switch mechanism is moved to the safety position, the safety selector switch mechanism configured and positioned to release the trigger from non-firing position to allow the trigger to move between the non-firing and firing positions when the safety selector switch mechanism is moved to the one or more fire positions.

5. A method of operating a firearm, comprising the steps of:

providing a firearm according to claim 4;

locking the trigger in the non-firing position by moving the safety selector switch mechanism to the safety position.

6. The method of claim 5, wherein the step of locking the trigger in the non-firing position by moving the safety selector switch mechanism to the safety position is performed while the hammer is not in the cocked position.

7. The method of claim 5, wherein the step of locking the trigger in the non-firing position by moving the safety selector switch mechanism to the safety position is performed while the hammer is in the fire position.

8. The method of claim 5, further comprising the steps of:

cocking the firearm while the trigger is locked in the non-firing position.

9. The method of claim 8, further comprising the steps of:

while the firearm is cocked, unlocking the trigger from the non-firing position by moving the safety selector switch mechanism from the safety position to the one or more fire positions.

10. The method of claim 9, further comprising the steps of:

firing the firearm by moving the trigger from the non-firing position to the firing position.

* * * * *